US005783505A

United States Patent [19]

Duckett et al.

[11] Patent Number: 5,783,505

[45] Date of Patent: Jul. 21, 1998

[54] COMPOSTABLE AND BIODEGRADABLE COMPOSITIONS OF A BLEND OF NATURAL CELLULOSIC AND THERMOPLASTIC BIODEGRADABLE FIBERS

[75] Inventors: Kermit E. Duckett; Gajanan S. Bhat; Hageun Suh, all of Knoxville, Tenn.

[73] Assignee: The University of Tennessee Research Corporation, Knoxville, Tenn.

[21] Appl. No.: 582,767

[22] Filed: Jan. 4, 1996

[51] Int. Cl.[6] ..... D04H 1/42; D04H 1/54; D04H 1/64; D04H 1/74

[52] U.S. Cl. ..... 442/411; 19/145.7; 28/116; 28/122; 156/308.2; 156/308.6; 442/414; 442/416

[58] Field of Search ..... 442/411, 414, 442/416; 28/116, 122; 156/308.2, 308.6; 19/145.7

[56] References Cited

U.S. PATENT DOCUMENTS 4,755,421 7/1988 Manning et al. ..... 428/224

5,114,537 5/1992 Scott et al. ..... 162/146

OTHER PUBLICATIONS

Duckett et al, *Textile Res. J.*, V66 (4), 1966, pp. 230–237.

Duckett et al., Compostable Nonwovens From Cotton/Cellulose Acetate Blends, "Nonwovens Conference", *TAPPI Proceedings*, pp. 89–96 (1995).

Duckett et al., Tensile Behavior of Solvent Pre-treated and Thermally Bonded Cotton/Cellulose Acetate Nonwovens, "Beltwide Cotton Conference", San Antonio, Texas, pp. 1–9 (Jan. 4–7, 1995).

*Primary Examiner*—James C. Cannon
*Attorney, Agent, or Firm*—Weiser & Associates, P.C.

[57] ABSTRACT

Compostable and biodegradable compositions of a blend of natural cellulosic and thermoplastic biodegradable fibers are disclosed. Typically the compositions include cotton and cellulose acetate. A process for the manufacture of a nonwoven composition which comprises a compostable blend of natural cellulosic fibers such as cotton and thermoplastic biodegradable fibers such as cellulose acetate; the blend is then carded to obtain the nonwoven composition.

38 Claims, 5 Drawing Sheets

Carbon dioxide evolution of cotton and CA fibers.

Carbon dioxide evoluation of 50/50 cotton/CA, cotton and CA fibers.

Carbon dioxide evolution of 75/25, 50/50 and 25/75 cotton/CA blend fibers.

Effect of calender roll temperatures (°C) on tensile properties in MD direction.

Effect of solvent vapor pretreatment times on tensile properties in MD direction of nonwovens bonded at various calendering temperatures (°C).

COMPOSTABLE AND BIODEGRADABLE COMPOSITIONS OF A BLEND OF NATURAL CELLULOSIC AND THERMOPLASTIC BIODEGRADABLE FIBERS

BACKGROUND OF THE INVENTION

The present invention relates generally to biodegradable, primarily compostable compositions, such as nonwoven materials, and more particularly, to compostable blends of natural cellulosic fibers, such as cotton, and thermoplastic biodegradable fibers, such as cellulose acetate.

Concerns for a clean environment have impacted not only textile manufacturers but also consumers in the choice of raw materials as well as final products. Public awareness is increasingly demanding biodegradable or environmentally friendly textiles, especially disposable nonwoven products. The possibility of composting disposable nonwoven products such as diapers, incontinence products and surgical gowns in landfills has attracted special attention in an effort to solve solid waste crises. However, there are only a few biodegradable fibers available which can serve as raw materials in nonwoven production, and in most cases such biodegradable fibers are expensive.

The biodegradation mechanism is generally explained by the enzymatic catalyzed process, where enzymes are produced by various microorganisms in the presence of degradable substrates. The requirements for microbial growth vary with temperature, pH and oxygen availability. Usually the presence of moisture and nutrients are necessary. The biodegradation process involves a number of different mechanisms, including hydrolysis and oxidation, which result in polymer chain scission. Intermediate products from the continuation of chain cleavages are water-soluble fragments. As total mineralization proceeds, further degradation products are $CO_2$, $H_2O$, $CH_4$, and/or biomass. Such activity is associated with both landfill conditions and composting. However, for landfill conditions, the decomposition is more likely to be anaerobic and for composting, the decomposition is more likely to be aerobic.

The biodegradation of cellulose has been intensively studied, and cellulose is believed to be readily biodegraded and mineralized by many microorganisms due to the activity of cellulase enzymes catalyzing the hydrolysis and/or oxidation of the cellulose. The main microorganisms responsible for the degradation of cellulose are fungi, bacteria and actinomycetes. Such microorganisms often interact synergistically, which results in the complete degradation of cellulose into carbon dioxide and water under aerobic conditions, and into carbon dioxide, methane and water under anaerobic conditions.

The cellulase enzymes are classified into three groups according to their catalyzed reactions; hydrolases, oxidases and phosphorylases. The hydrolase enzymes catalyzing the hydrolysis of cellulose are endo- and exo-enzymes, and β-glucosidase. These enzymes are responsible for the random scissions of cellulose chains in amorphous regions or at the surface of microfibrils, for the cleavages of non-reducing ends of the cellulose chains by releasing cellobiose and in some cases, glucose, and for eliminating oligosaccharides, especially cellobiose, respectively. Although the exact mechanisms of the complicated cellulase systems are not totally understood, studies have shown that enzymatic degradation is the result of synergistic actions, which is susceptible to inhibition and induction processes. The evidence of the enzyme action in a synergistic manner is based on the higher activity of the recombined enzymes than would be expected from the sum of the individual activities.

The enzymatic activities on cellulosics are influenced by many factors depending on their morphological, chemical and physical structures; the higher the degree of polymerization, and the greater the degrees of crystallinity and orientation, the less susceptibility to microbial attack due to limited accessibility. In a cotton fiber, the degree of polymerization is as high as 14,000 and the degree of crystallinity is in a range of 50 to 94%, which would suggest that cotton is not vulnerable to enzymatic attack. However, the large number of hydroxyl groups in cellulose make cotton fibers hydrophilic and attract the growth of microorganisms. Thus, it is generally accepted that unfinished cotton fibers are biodegradable.

Cellulose acetate (CA), an ester of cellulose, is produced by the partial hydrolysis of cellulose triacetate. Since the hydroxyl groups in cellulose acetate are blocked and substituted by acetyl groups in various degrees, the biodegradability of cellulose acetate is less certain. The effects of the degree of substitution in each anhydroglucose unit on microbial attack have been intensively studied. These studies have shown that at least one substituent on every anhydroglucose unit resulted in complete resistance to microbial attack on cellulose due to the chemical blocking of one or more of the hydroxyl groups and that cellulose derivatives with a degree of substitution (DS) above 1.0 were not biodegradable at all. These studies also showed that cellulose acetate with a degree of substitution of 1.0 was not susceptible to enzymatic degradation (by noting a 0% weight loss). It has also been shown that esterase, an enzyme in cellulolytic fungi, is capable of deacetylating insoluble cellobiose octaacetate, and that the esterase produced on soluble cellulose acetate with a degree of substitution of 0.76 could hydrolyze cellulose to cellobiose, and with the addition of β-glucosidase, could deacetylate soluble cellulose acetate.

Recently, cellulose acetate films have been shown to be biodegradable in various environments. In both aerobic compostors and anaerobic bioreactors, cellulose acetate films with degrees of substitution of 1.7 and 2.5 were degraded, and the bacterium *Pseudomonas paucimobilis* was isolated and identified as responsible for the microbial growth on the cellulose acetate films. Studies have shown that cellulose acetate films with degrees of substitution of 1.7 and 2.5 are partially degraded, resulting in weight losses and decreases in thickness and tensile strength.

There has recently been an increased interest in the use of cotton fiber in nonwoven blends, especially with thermal bonding processes. Primarily, this is because of cotton's natural comfort properties and biodegradability, and the development of bleached cotton processability. Several different heat-fusible, thermoplastic synthetic fibers such as low melting polyester copolymer, polypropylene and polyethylene have been used as binder fibers in nonwoven products containing cotton fibers as base fibers. However, it has been found that higher cotton blend content results in a decrease in strength, and requires higher bonding temperatures. In addition, disposability of the synthetic binder fibers is limited.

Cellulose acetate fiber have desirable cellulosic and thermoplastic characteristics. For example, cellulose acetate binder fibers exhibit relatively low softening temperatures (in the range of 180° to 205° C.) and are easily wettable. The use of cellulose acetate binder fibers also eliminates the need for non-biodegradable synthetic fiber or chemical binder. In addition, cellulose acetate is soluble in many common solvents such as acetone, low boiling ketones and methylene chloride. The chemical modification of cellulose acetate with plasticizing agents also provides additional flexibility in thermal bonding by enhancing bonding adhesion and lowering bonding temperatures.

Softening agents or plasticizers for thermoplastic biodegradable polymers other than cellulose will vary and are known in the art. In addition, tests to determine whether an agent is a suitable softening agent or plasticizer are likewise known in the art.

Penetration of solvents into cellulose acetate fibers involves the breakdown of intermolecular bonds and produces increased segmental mobility of the polymer chains, leading to a lower glass transition temperature of the fiber. Such solvent bonding is described, for example, in U.S. Pat. Nos. 2,277,049 and 2,277,050, both of which are incorporated herein by reference. The solvents for cellulose acetate fibers were found to provide latent adhesive or coalescent characteristics. For example, it has been found that cellulose acetate fibers containing 30% plasticizer could be softened sufficiently to bond with other fibers by calendering at temperatures in the range of 176° to 190° C. It has also been found that a solvent such as sulpholane can be applied to opened and blended fibers before carding, with a solvent addition by weight in the range of 10 to 15% of the fibers. In the curing stage, the solvent on the fibers is activated by heat, and the cellulose acetate fibers are bonded at temperatures between 90° and 140° C. In general, it has been found that solvent bonded fabrics have excellent strength and resilience.

SUMMARY OF THE INVENTION

It is the primary object of the present invention to provide biodegradable and/or compostable compositions comprising a blend of natural cellulosic fibers and thermoplastic biodegradable fibers.

Natural cellulosic fibers include those cellulosic fibers which are produced by plants. Examples of natural cellulosic fibers, each of which is suitable for the composition of the invention, include but are not limited to cotton, jute, flax, ramie, hemp, kenaf, abaca, sisal, kapok, bagasse, eucalyptus, and rayon (reconstituted cellulose).

Thermoplastic biodegradable fibers which are suitable for the composition of the invention include those fibers which are both thermoplastic, that is that flow in the presence of heat so that heat can be used to bond the fibers, and biodegradable, that is that can be broken down in the presence of microbial enzymes by biologic processes. Non-limiting examples of suitable thermoplastic biodegradable fibers include lower alkyl cellulose esters, like cellulose acetate, including cellulose acetate butyrate (CAB), cellulose acetate propionate (CAP), and triacetate cellulose, polylactic acid, starch, polyvinyl alcohol (PVA), chitosan, and PHBV (copolymer of polybetahydroxy butyrate and betahydroxyvalerate).

In this specification, the invention is illustrated by means of a blend of cotton fibers and cellulose acetate fibers. It will be understood by those skilled in the art that the compositions and methods of the invention are applicable to natural cellulosic fibers other than cotton or in a blend with cotton, such as those listed above, and to thermoplastic biodegradable fibers other than cellulose acetate or in a blend with cellulose acetate, such as those listed above.

It is also an object of the present invention to provide a solvent-assisted thermal bonding process for enhancing the tensile properties of natural cellulosic-based thermoplastic biodegradable nonwoven materials.

It is also an object of the present invention to provide a biodegradable natural cellulosic-based thermoplastic biodegradable nonwoven material.

It is also an object of the present invention to provide a compostable natural cellulosic-based thermoplastic biodegradable nonwoven material, and a solvent-assisted thermal bonding process for producing such materials.

These and other objects which will become apparent are achieved in accordance with the present invention which is illustrated in a preferred mode by using cellulose acetate as the binder fiber in a thermally bonded nonwoven material containing cotton as the base fiber. The resulting material is made biodegradable, and is compostable, enhanced degradation is provided by the cotton fibers and enhanced tensile strength of the blended nonwoven may be provided by solvent modification.

Compositions and materials of the invention may include minor amounts of materials which may or may not be compostable or biodegradable, such as plasticizers or other solvents, so long as the non-compostable or non-biodegradable materials do not adversely affect the desired properties of the compositions or materials of the invention, such as compostability to an undesirable extent.

The inventors have discovered that cellulose acetate fibers with a degree of substitution of 2.5 can be degraded by microbial attack, as confirmed by strength loss and carbon dioxide evolution. Further, in accordance with the present invention, the inventors have discovered that combining a natural cellulosic fiber with a thermoplastic biodegradable fiber results in a synergistic effect in terms of biodegradability and compostability. Moreover, it has been discovered that the synergistic enzymatic effect of natural cellulosic fibers, such as cotton, blended with thermoplastic biodegradable polymeric fibers, such as cellulose acetate, promotes the fabrication of environmentally friendly nonwoven fiber blends.

Though a synergistic effect has been noted in compositions of the invention, the invention is not predicated on that effect but provides a useful composition which has an advantageous combination of properties.

Further in accordance with the present invention, carded webs of natural cellulosic/thermoplastic biodegradable fibers, such as cotton/cellulose acetate fibers, are subjected to a solvent pretreatment to lower processing temperatures as well as to enhance the tensile strength of the resulting thermally bonded nonwoven materials. The solvent is selected to be a solvent for the thermoplastic biodegradable fiber. This results in biodegradable, all-cellulosic nonwoven materials with greatly increased strength, which can be made available to satisfy the need for environmentally clean, nonwoven materials for consumer and health care applications.

For a further discussion of the foregoing improvements, reference is made to the detailed description which is provided below, taken in conjunction with the following illustrations.

DETAILED DESCRIPTION OF PREFERRED EMBODIMENTS

Figure 1:
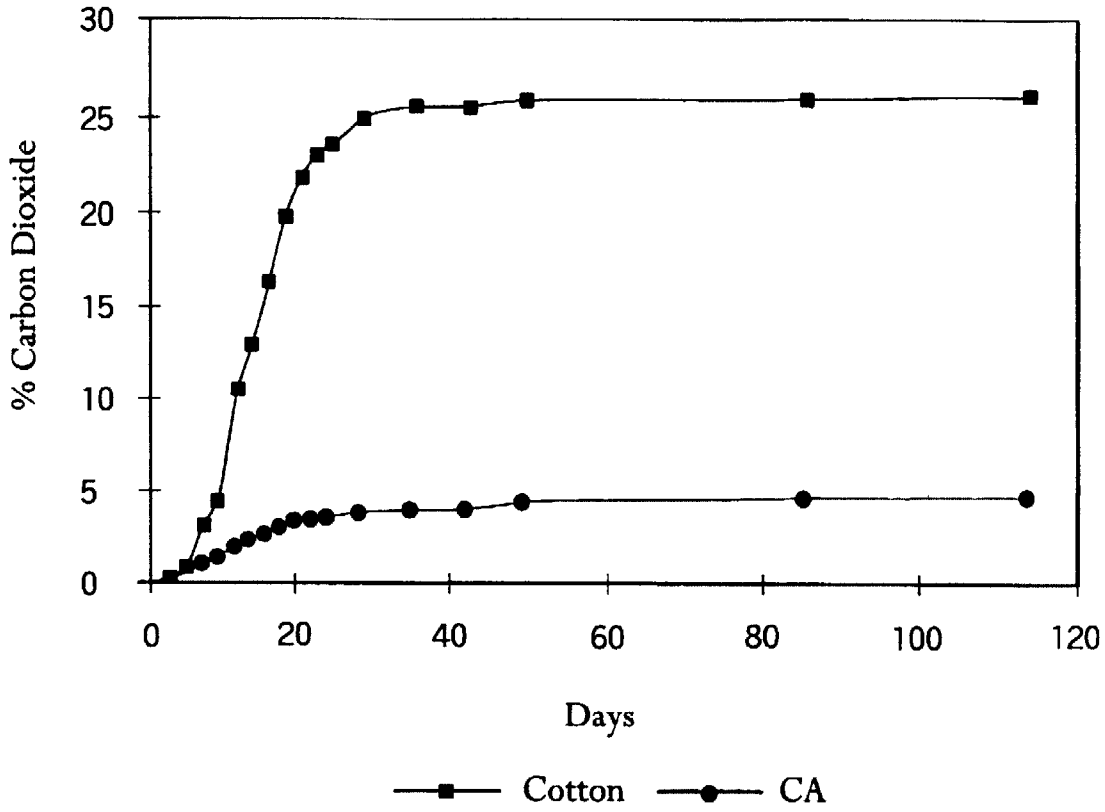
FIG. 1 is a graph showing the rate of decomposition of cotton and cellulose acetate fibers as a function of time.

In a preferred embodiment selected for illustrating the improvements of the present invention, scoured and bleached commodity cotton fibers (Cotton Incorporated) were selected having a moisture content of about 5.2%, a micronaire value of about 5.4, and an upper-half-mean fiber length of about 2.44 cm. The fibers were scoured to remove their natural wax surface coating, to provide an improved bonding surface to the binder fibers. Alternatively, the fibers may be left unscoured.

Cellulose acetate staple fibers (Hoechst Celanese Corporation) having comparable denier and fiber lengths to those of the cotton fibers (a degree of substitution of 2.5, an acetyl value of 55%, and a moisture content of 5.0%) were also selected for use. Because modified cellulosic fibers are thermoplastic, they have easy wettability, good liquid transport and high moisture uptake. A major advantage is that acetate is made from renewable sources, such as wood pulp and cotton linters, contributing to good compostable/biodegradable characteristics. Another advantage is that cellulose acetate is a thermoplastic fiber having a softening temperature of about 180° C. As a consequence, when cellulose acetate is used as a binder fiber processed by thermal calendering, a cotton/cellulose acetate product can be produced that eliminates the use of any non-biodegradable synthetic fiber or chemical binder.

Each of the fiber components was prepared by separate processing through an opener. The two types of fibers were then blended, e.g., in a ratio of 75/25 cotton/cellulose acetate, by hand mixing. The fibrous blend, composed of a total of 50 grams, was then carded to form a multi-layered web using a modified Hollingsworth card. The resulting carded web had a basis weight of 160 g/m$^2$. Alternatively, the fibrous blend may be carded to form a single-layered web, having a basis weight of 5 to 100 g/m$^2$, such as 5–20 g/m$^2$, or up to 200 g/m$^2$ if desired, as is known in the industry.

The fibers of the carded webs were then thermally bonded to each other using a Ramisch Kleinewefers 600-mm (23.6-inch) wide five roll calender. The effect of varying the processing variables of temperature, feed speed, and nip roll pressure on the effectiveness of bonding is important and the operational parameters used should be selected to give reasonably optimum conditions. As an example, and for the illustrative embodiment being described, the feed roll speed and nip roll pressure were fixed at constant values of 10 m/min and 100 kN/m, respectively.

The thermally bonded nonwoven fabrics, produced under different processing conditions, were then evaluated. Determinations of tensile strength were performed on a United Tensile Tester, according to test method ASTM D1117-80 ("Tensile Testing of Nonwoven Fabrics"). The tensile tests were replicated five times and an average value was obtained in both machine and cross-machine directions.

The prepared materials were tested for biodegradability/compostability of the textile fibers. The two standard test methods used for this were AATCC (American Association of Textile Chemists and Colorists) 30-1988 ("Antifungal Activity, Assessment on Textile Materials: Mildew and Rot Resistance of Textile Materials") and ASTM D5209-91 ("Standard Test Method for Determining the Aerobic Biodegradation of Plastic Materials in the Presence of Municipal Sewage Sludge").

An AATCC soil burial test (according to standard AATCC 30-1988) was performed by first preparing a soil bed, by mixing garden and potting soils in a ratio of approximately 1:1. The moisture content of the soil mixture was controlled (in the range of 20–30%) by adding distilled water, as needed. Five 1"×7"replicated samples (each of 100% cotton, 50/50 cotton/cellulose acetate blend, and 100% cellulose acetate fabric) were prepared and placed within the soil bed. The incubation temperature was held by a garden lamp to a range of 25°–30° C. Each week, the moisture content was readjusted by spraying with water, and the fabric samples were examined visually. Although the cotton samples were only visually examined in this soil bed test, the biodegradability of the cellulose acetate fabric was later evaluated quantitatively, with strength tests.

After two weeks, the 100% greige cotton fabric indicated degradation by showing holes in the fabric. There was total degradation, or fabric disappearance, after six weeks in the soil bed. The 50/50 cotton/cellulose acetate blend began to show degradation after four weeks. After six weeks, only the cellulose acetate fibers remained intact. For the 100% cellulose acetate fabric, no visual degradation was observed for up to 12 weeks. However, the white cellulose acetate fabric was severely contaminated by the soil even after rinsing the fabric with distilled water. Since the cotton and the blend fabric could not be recovered after 12 weeks in the soil bed, only the cellulose acetate fabric was evaluated for strength retention. The breaking load values for the untreated and the treated cellulose acetate fabric were 18.68 kg and 13.64 kg, respectively. This evidences microbial attack on the cellulose acetate fabric, on the basis of a 27% strength loss. Weight loss measurement was not possible due to soil contamination, which might otherwise have led to a weight gain.

An ASTM aerobic sludge test (according to standard ASTM D5209-91) was performed by connecting a series of Erlenmeyer flasks to one another (with flexible tubing) in such a way as to provide carbon dioxide scrubbing, bioreactor and carbon dioxide trapping stages. A controlled volumetric flow rate of air was continuously provided through the series of sealed flasks.

The carbon dioxide scrubbing component was comprised of three flasks in series. The first flask contained 700 mL of 10N sodium hydroxide solution and the second flask contained 700 mL of 0.025N barium hydroxide solution. The third flask remained empty and was included to prevent accidental overflow into the bioreactors that followed.

Plural bioreactors were connected in parallel. Each bioreactor contained a 1% inoculum prepared from sludge and medium stock solution. One flask included cotton fiber as a known biodegradable control against which the cellulose acetate was to be compared. A flask without a fiber sample acted as a check against carbon dioxide generation by the sludge alone. All of the bioreactors were placed on magnetic stirrers to provide proper oxygen and mixing.

The bioreactors were then followed by carbon dioxide trapping units comprised of a series of 125 mL flasks, each containing 100 mL of 0.025N barium hydroxide.

Sludge containing, activated microorganisms were obtained from the Kawahee Wastewater Plant, Knoxville, Tenn. Enough supernatant (15 mL for each bioreactor) was taken out to be used for preparing the 1% inoculum. A 1% inoculum, composed of medium stock solution, sludge inoculum and high quality water, was prepared for each 2-L bioreactor. A 13.5 mL medium stock solute was prepared, and was composed of magnesium sulfate, calcium chloride, ammonium sulfate, a phosphate buffer (made of potassium phosphate dibasic, potassium phosphate monobasic, sodium phosphate dibasic and ammonium chloride) and ferric chloride. Fibers in an amount equal to 500 mg (for each bioreactor) were chopped to approximately 5 mm in length.

When the $Ba(OH)_2$ solution in the trapping flasks began absorbing evolved $CO_2$, the precipitation of barium carbonate was observed. Every few days, the $CO_2$ absorbing flasks nearest each bioreactor were removed for titration with an HCl solution. The amount of $CO_2$ evolved from the control sludge bioreactor was subtracted from that generated in the bioreactors containing fibrous materials. The actual amount of $CO_2$ evolved was calculated from the amount of HCl solution used in titration, and the amount, molecular weight and carbon content of fibers in each bioreactor.

The test was continued until $CO_2$ evolution reached a plateau. Throughout the experiment, the temperature was controlled to 25° C. ±5° C. Insoluble or solid matter, and biomass that remained in the bioreactors was filtered using ASTM 40–60 crucible holders or 0.2 μm cellulose acetate membrane filters. A small amount of solution was removed to measure initial and final pH and total organic carbon (TOC) content. Total organic carbon contents were obtained with a Dohrmann Carbon Analyzer, in which the concentration of oxidizable carbon matter (such as soluble or insoluble organic carbons) was measured.

The ASTM aerobic sludge tests were conducted in three separate experiments. In a first experiment, 100% cotton and 100% cellulose acetate fibers were evaluated to confirm their biodegradability. In second and third experiments, blends of fibers with different blend ratios were tested for comparative and for possible synergistic actions between the enzymes responsible for microbial degradation of cotton and cellulose acetate fibers.

To investigate the biodegradation of cotton and cellulose acetate fibers, visual observations were made throughout the experiment for qualitative analysis. After two days, the cotton fibers began to dissolve. After 10 days, no fiber structure was observed. There was, however, significant carbon dioxide evolution. After 14 days, the solution in the standard bioreactor containing cotton fibers became clear of any solid matter. A growth of algae was observed after two months. The above results confirmed the activity of microorganisms in the test procedures, and were comparable to the results from the soil burial test (which had indicated severe degradation of the cotton fibers after two weeks). There was a breakdown and dissolving of the cellulose acetate fibers after 20 days. A growth of algae was observed after three months. Throughout the experiment, the blank bioreactor did not show any visual change in terms of its color, clarity or sign of algae growth.

The cumulative percentage of carbon dioxide evolution over time is shown in FIG. 1. For the cotton fiber alone, a total of 26.1% carbon dioxide was evolved after 114 days. Most of this carbon dioxide was produced within 20 days, a period of time comparable to essentially total degradation in the soil burial test. Even though one of the criteria for the standard procedure is more than 70% carbon dioxide evolution for positive control materials such as soluble cellulose and starch, a high percentage of $CO_2$ evolution from cotton fibers could not be obtained. This is attributed to the high degree of polymerization, high crystallinity and/or orientation values in cotton cellulose.

Although the biodegradability of cellulose-including cotton fabrics has been intensively studied, most studies have been based on the weight or strength loss of cotton fabrics. Cotton fibers easily disintegrate from microbial attack, resulting in 100% weight or strength loss within 20 days. However, a 100% $CO_2$ evolution of cotton fibers could not be obtained, mainly because of the large amount of crystalline microfibrils present. Crystalline cellulose is highly resistant to enzymatic attack due to limited action of the cellulase, especially endo-glucanase. In addition, since $CO_2$ evolution is an indication of mineralization of the polymeric chains, the amounts of oligomers and soluble cellobiose (which are also degraded products) should be considered. Another possible mechanism in the biodegradation of cotton fibers is the limited activity of β-glucosidases, which are responsible for cellobiose elimination and rate of biodegradation. Therefore, complete conversion of cotton fibers to glucose can not be obtained, due in part to the large amount of cellobiose accumulation which inhibits the activities of both exo- and endo-glucanases.

The total percentage of carbon dioxide evolved from the cellulose acetate fibers was 4.93% over 114 days. This was approximately one fifth of that evolved from the cotton fibers. Cellulose acetate fiber does not degrade as rapidly as cotton. However, it is clear that there is microbial activity-producing esterase enzymes that contribute to its degradation.

The final results of pH change, total carbon dioxide evolved, total organic carbon change and weight loss (or remaining solid matters) are shown in Table 1 and were significant.

TABLE 1

Summary of Biodegradation of Cotton and Cellulose Acetate Fibers (CA)

| Sample (500 mg) | Cotton | Cellulose Acetate |
|---|---|---|
| Total Carbon Source | 222 mg | 246 mg |
| pH (From 7.9) | 6.50 | 6.80 |
| Total $CO_2$ Evolved | 26.1% | 4.93% |
| TOC content | 19.8 ppm | 1.866 ppm |
| Remaining Biomass/Fibers | 96 mg | 470 mg |

There was an increased acidification of the solutions. This is attributed to the increase in the amount of $H^+$ ion generated by carbonic acid, $H_2CO_3$, which is made from $CO_2$ in dissolved water, and/or by the increase in the amount of degraded fragments such as lactic acid and acetic acid. In addition, the increase in total organic carbon both from the cotton and cellulose acetate bioreactors could be an indication of the increase in carbon content in solution solely from the test samples as carbon sources for microorganisms. No cotton fiber remained in the bioreactors, resulting in 100% weight loss. A large amount of algae was filtered out. For the cellulose acetate fibers, weight loss could not be measured due to the difficulty in separating solid cellulose acetate fractions and algae. This result is contrary to previously postulated values, which expected a microbial resistance for cellulose acetate fabrics with a degree of substitution above 1.0. Such differences are attributed to the fact that prior studies were carried out on the basis of weight loss of the cellulose acetate substrates.

Figure 2:
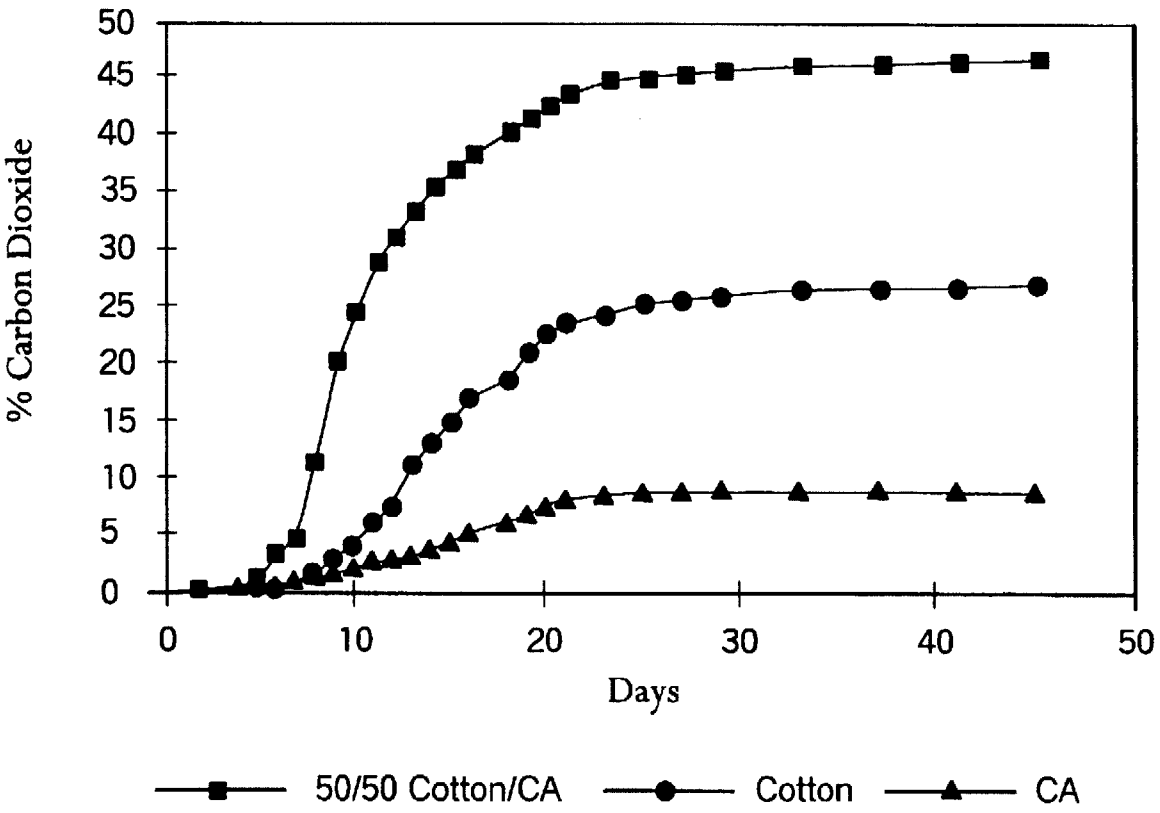
FIG. 2 is a graph showing the rate of decomposition of a 50/50 cotton/cellulose acetate blend, and of cotton as well as cellulose acetate fibers as a function of time.

To investigate the biodegradation of 50/50 cotton/cellulose acetate fibers, similar visual observations were made for the cotton and cellulose acetate bioreactors. In the case of the bioreactor containing the 50/50 blend fibers, the solution began to clear of yellow fibrous material after 9 days. The cumulative percentage of carbon dioxide evolution over time is shown in FIG. 2. For the cotton and cellulose acetate fibers, total values of 27.04% and 9.18% of carbon dioxide, respectively, were evolved after 45 days. This data provides further confirmation of the biodegradability of cotton and cellulose acetate fibers, and also demonstrates the reproducible microbial activity of the test method. Final results in pH and total organic carbon changes, and in the amount of biomass and remaining materials, are shown in Table 2.

TABLE 2

Summary of Biodegradation of Cotton, Cellulose Acetate and 50/50 Cotton/Cellulose Acetate Blend Fibers

| Sample (500 mg) | Cotton | 50/50 Cotton/ Cellulose Acetate | Cellulose Acetate |
|---|---|---|---|
| Total Carbon Source | 222 mg | 234 mg | 246 mg |
| pH (From 7.8) | 6.48 | 6.35 | 6.71 |
| Total $CO_2$ Evolved | 27.04% | 46.5% | 9.18% |
| TOC content | 6.760 ppm | 6.770 ppm | 3.910 ppm |
| Remaining Biomass/Fibers | 204.8 mg | 245.2 mg | 465.2 mg |

In this segment of the experiment, 0.2 μm membrane filters were used for the complete filtration of microorganisms in the bioreactors. This resulted in an increase in the amount of biomass and remaining materials, and a decrease in the total organic carbon changes.

The total carbon dioxide evolution for the cotton/cellulose acetate blend was 46.5% over 45 days. This unexpected value was much greater than that of the 100% cotton fibers. In addition, the rate of degradation was significantly greater than that of the cotton fibers alone. This surprising result suggests a synergistic effect of esterase and cellulase enzymes, as well as the reduction of the cellobiose cumulation by increased activity of glucosidases. It is believed that greater amounts of esterases and cellulases are induced in the presence of the two fibers.

Figure 3:
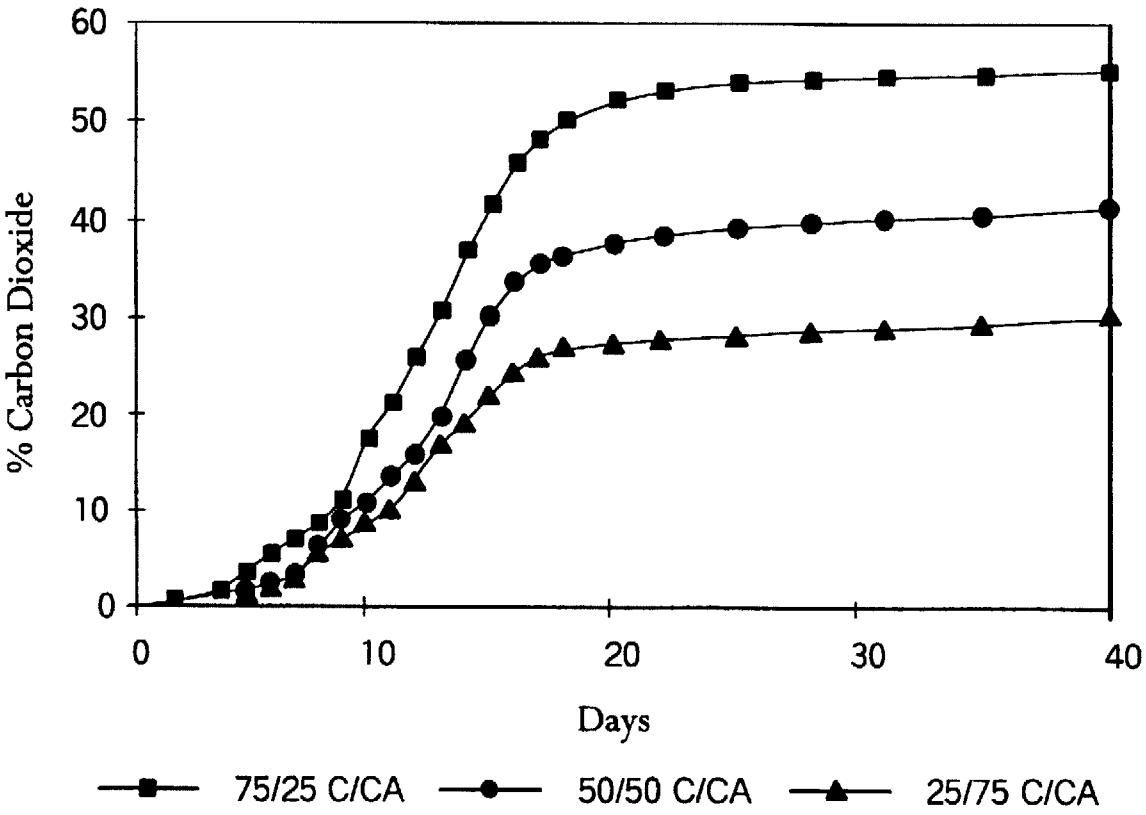
FIG. 3 is a graph showing the rate of decomposition of a 75/25 cotton/cellulose acetate blend, and of cotton as well as cellulose acetate fibers as a function of time.

To investigate the biodegradation of 75/25 and 25/75 cotton/cellulose acetate fibers, and to understand the synergistic effect of esterase and cellulase enzymes, cotton/cellulose acetate fibers with different blend ratios (75/25 and 25/75) were tested against 50/50 cotton/cellulose acetate fibers as a positive control. Since the molecular weight and chemical structure of cotton and cellulose acetate fibers are similar, the carbon content of each bioreactor (containing 500 mg of fibers) covered essentially the same range. Therefore, the carbon source available for microbial activity was the same irrespective of the blend ratio. The cumulative percentage of carbon dioxide evolution over time is shown in FIG. 3, and the final analysis of the resulting system is shown in Table 3.

TABLE 3

Summary of Biodegradation of 75/25, 50/50 and 25/75 Cotton Cellulose Acetate Blend Fibers

| Sample (500 mg) | 75/25 Cotton/ Cellulose Acetate | 50/50 Cotton/ Cellulose Acetate | 25/75 Cotton/ Cellulose Acetate |
|---|---|---|---|
| Total Carbon Source | 228 mg | 234 mg | 240 mg |
| pH (From 7.8) | 6.38 | 6.52 | 6.51 |
| Total $CO_2$ Evolved | 55.49% | 41.66% | 30.53% |

TABLE 3-continued

Summary of Biodegradation of 75/25, 50/50 and 25/75 Cotton Cellulose Acetate Blend Fibers

| Sample (500 mg) | 75/25 Cotton/ Cellulose Acetate | 50/50 Cotton/ Cellulose Acetate | 25/75 Cotton/ Cellulose Acetate |
|---|---|---|---|
| TOC content | 6.794 ppm | 6.693 ppm | 6.038 ppm |
| Remaining Biomass/Fibers | 217.5 mg | 271.1 mg | 316.7 mg |

For the 50/50 cotton/cellulose acetate blends, a total of 41.7% of carbon dioxide was evolved after 40 days. Also, the pH and total organic carbon changes, and the biomass and remaining material showed similar trends as those observed in the second test of the 50/50 blend fibers.

The level of carbon dioxide produced varied in relation to the cotton content in the blend. The amount of carbon dioxide evolved was 55.5%, 41.7% and 30.5%, respectively, for the 75/25, 50/50 and 25/75 cotton/cellulose acetate blends. Also, the pH and total organic carbon changes were greater in the solution from the bioreactor of high cotton content. In particular, the amount of carbon dioxide evolved from the bioreactors containing the fiber blends, regardless of the different blend ratios, was greater than that of the individual fibers. This confirmed the synergistic effect of esterase and cellulase enzymes. Moreover, the greater carbon dioxide evolution and the faster rate of biodegradation of blends of fibers with a higher cotton content suggest that cellulase enzymes were favorably induced over esterase.

Thus, cotton/cellulose acetate fiber blends in various ratios such as 75/25, 50/50, and 25/75 are shown above to have a synergistic effect in terms of biodegradability and compostability. In addition, fiber blends of 85/15 (cotton/cellulose acetate) have been made. It is conceived that cotton/cellulose acetate blends with a ratio as high as 95/5 or as low as 5/95 will show synergistic effects.

Further, in accordance with the present invention, and to optimize the properties of the nonwoven fabrics previously described, a softening agent was used to pre-treat the cellulose acetate fibers. Acetone, a common solvent for cellulose acetate that is easily vaporized at room temperature and which does not affect cotton fibers, was used in the gaseous state on the carded webs, as a pretreatment prior to calendering. The acetone was poured into containers for receiving the webs on a perforated rack, above the liquid reservoir of acetone. There was no liquid/fabric contact. The containers were then covered by an air tight, removable top, and the webs were allowed to condition in the saturated acetone vapor atmosphere. After the webs were subjected to a saturated vapor atmosphere of acetone, the webs were removed from the acetone vapor and immediately calendered. In the solvent-assisted calendering procedure, the bonding temperature was found to be lower than the softening temperature of solvent-untreated cellulose acetate fibers.

Alternatively, treatment of the webs with acetone or other plasticizer or softening agent may be performed by immersing the carded web in the solvent. It is not necessary that the webs be saturated with the solvent, so long as treatment with the solvent is for a time sufficient to soften the surface of the thermoplastic component throughout the entire portion of the web which is exposed to the solvent.

Figure 4:
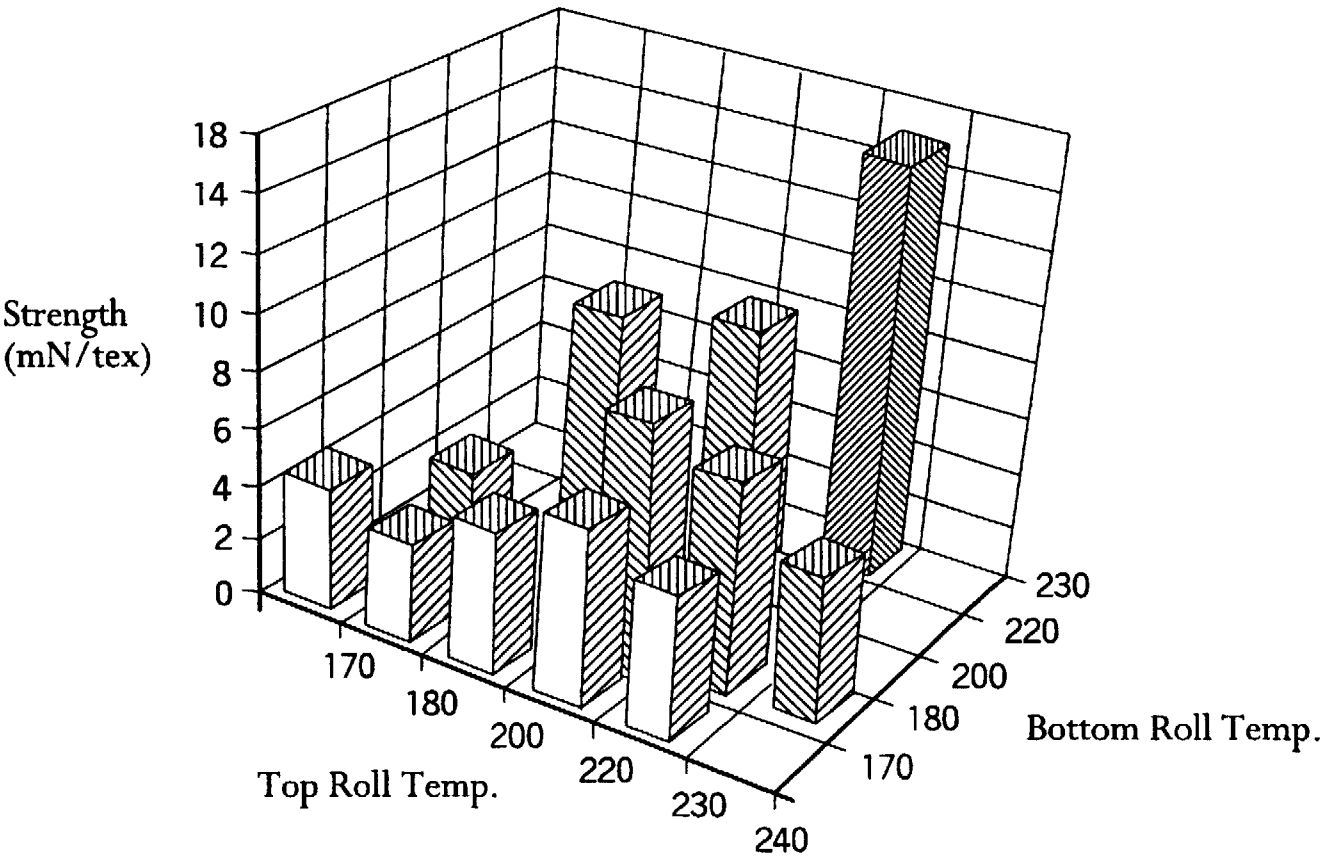
FIG. 4 is a bar graph showing the effects of calender roll temperature on the tensile properties of materials produced in accordance with the present invention.

In order to illustrate the above improvements, carded webs of 75/25 cotton/cellulose acetate fibers were thermally bonded at selected temperatures. To observe thermal conditions on the bonding properties of cellulose acetate to cotton fibers, the carded webs were first calendered without a solvent treatment at bonding temperatures in a range of 170° to 240° C. Tensile tests were then performed, and the results of these tests are shown in FIG. 4. Fabric strengths in the machine direction (MD) increased with temperature, as expected. However, there was a sharp rise in strengths for temperatures at about 230° C. Except for the higher temperatures, the strengths in the machine direction did not exceed 10 mN/tex below bonding temperatures of 20° C. above the softening temperatures of the cellulose acetate fibers (i.e., 180°–205° C. Results for the strengths in the cross direction showed a similar trend as those for the strengths in the machine direction. Generally, there was an increase in strength with temperature, especially at bonding temperatures above 200° C.

Figure 5:
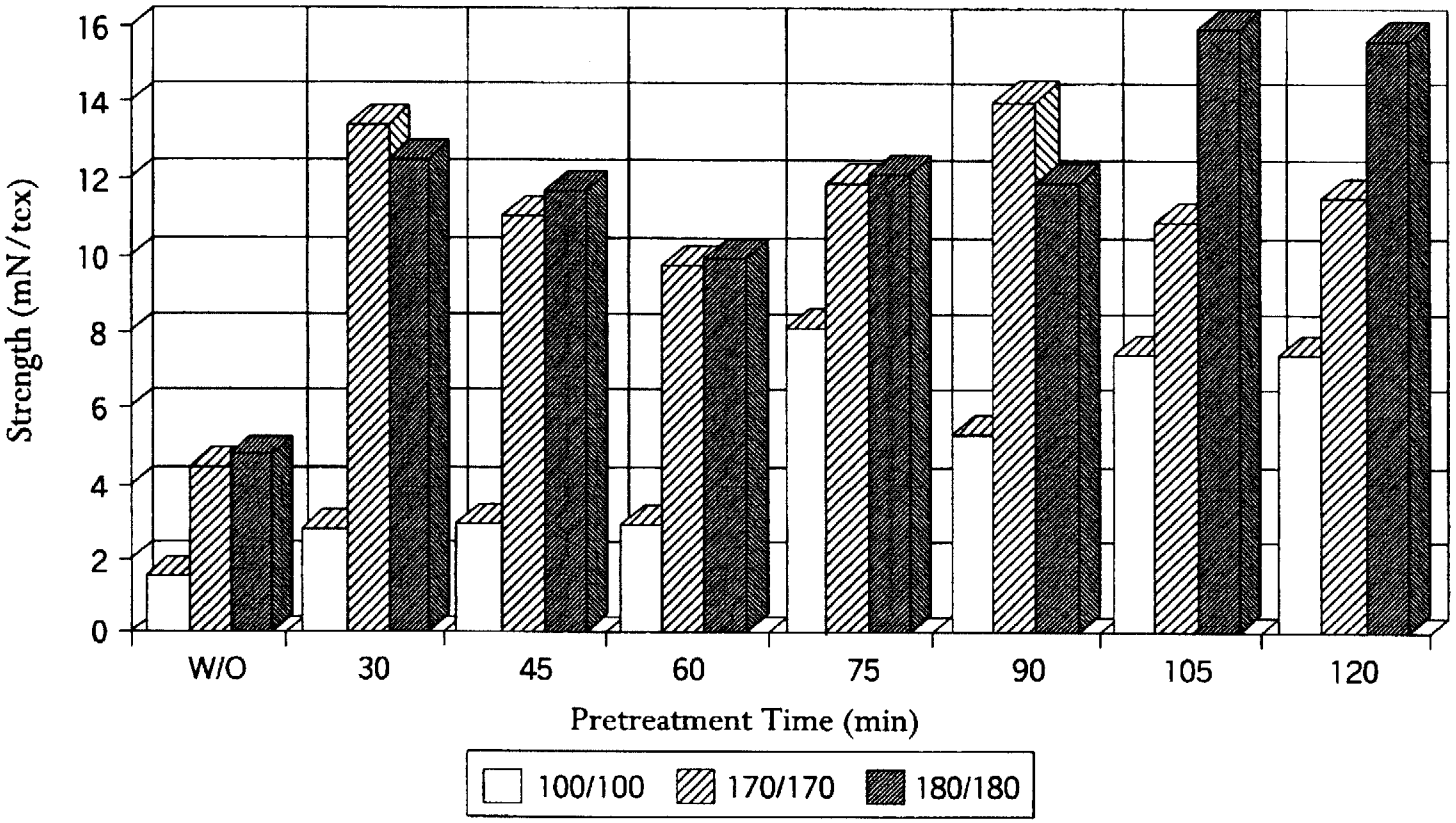
FIG. 5 is a bar graph showing the effect of solvent vapor pretreatment on the tensile strength of materials produced in accordance with the present invention.

The tensile behavior of the thermally bonded nonwovens with solvent pretreatment, in the machine direction, is shown in FIG. 5. The solvent pretreatments were carried out at saturation times in the range of 30 minutes to 2 hours, with 30 minute intervals. Three combinations of bonding temperatures (100°, 170°and 180° C.) were selected, which were lower than the softening temperatures of cellulose acetate. Higher temperatures and longer pretreatment times resulted in greater fabric strengths. The solvent pretreatment provided remarkable enhancement in tensile properties (MD strengths) compared with non-treatment. Most fabrics bonded at 170° C. and 180° C. following solvent pretreatments, resulted in strengths in the machine direction exceeding 10 mN/tex. This is similar to the results obtained from nonwovens bonded at 230° C. without a solvent treatment. Even nonwovens bonded at 100° C. showed increased strengths with longer solvent pretreatment times. Increases in pretreatment times allow reduction in calendering temperatures and increased calendering speeds. However, increased calender speeds generally require higher calender temperatures because of heat transfer dynamics. Typical calendering speeds in industry are between about 10 to 100 m/min, for example 10 to 50 m/min.

The remarkable strength enhancement occurred with nonwovens exposed to the acetone vapor for thirty minutes. This result probably means that surface softening is sufficient to activate a mechanism that raises the strength of the calendered fabric by a factor close to three, while doing so at reduced temperatures. Another possible explanation arises from the mechanism of fiber-solvent interactions, in which solvents lower the softening or glass transition temperatures of fibers. Therefore, the short saturation pretreatment time was sufficient to modify the cellulose acetate fiber on the surface or in the amorphous regions, which changed the effective softening temperature of the cellulose acetate. That alone would explain the enhanced bonding at temperatures lower than the original softening temperatures of the cellulose acetate fibers. The above result can be extremely beneficial from an energy standpoint and from the knowledge that cotton fibers become brittle and weak when processed at temperatures significantly above 200° C.

It is preferred that the time between solvent pre-treatment and calendering be kept to a minimum. Ideally, calendering should be virtually immediately following the softening. However, since this is often impractical, it is preferred that calendering be performed on softened portions of the pretreated web within 10 seconds of removal from the softener solvent.

It is preferred that the travel of the carded web during softening and during calendering be at a constant speed, preferably the same speed for softening and for calendering. However, if desired, the travel of the web during softening and calendering may be at different rates of speed.

The embodiments of the invention illustrated above with cotton and with cellulose acetate can be performed using any natural cellulosic material and any thermoplastic biodegradable polymer, such as the ones listed above. Tests summarized in Tables 1–3 can be performed on any combination of fibers of natural cellulosic material and thermoplastic biodegradable polymer to verify the synergistic activity of the two fibers in terms of biodegradability and compostability.

Specifically, Table 1 and Table 2 show that Total $CO_2$ evolved from cotton alone is about 27% and for cellulose acetate alone is between about 5 and 9%. Therefore, if there were no synergism from the combination of the two fibers, one would expect the Total $CO_2$ evolved from a combination of the fibers to be equal to (27%×% cotton)+(9%×% cellulose acetate), which is between 9 and 27%. However, the value shown in Tables 2 and 3 indicate Total $CO_2$ evolved from a combination of cotton and cellulose acetate to be between 30.53% and 55.49%, indicating synergy.

When in the blends shown above (in the Tables), cotton is partially or totally replaced by rayon, satisfactory compostable compositions will be obtained. Likewise, when the cellulose acetate is partially or totally replaced by starch fibers, satisfactory compostable compositions will be obtained.

Thus, in order to determine synergy of biodegradability or compostability from the combination of a natural cellulosic fiber and a thermoplastic biodegradable polymeric fiber, one can determine the Total $CO_2$ evolved for each fiber individually and the Total $CO_2$ evolved for a blend of the two fibers. If the Total $CO_2$ evolved for the blend is higher than would be expected from the individual values of Total $CO_2$ evolved, the two fibers have a synergistic activity for biodegradability and compostability.

Accordingly, various blends of natural cellulosic fibers and thermoplastic biodegradable fibers are produced, in ratios of 95/5, 90/10, 85/15, 75/25, 50/50, 25/75, 15/85, 10/90 and 5/95. The natural cellulosic fibers in the blends are selected from cotton, jute, flax, ramie, hemp, kenaf, abaca, sisal, kapok, bagasse, eucalyptus, and rayon. The thermoplastic biodegradable fibers in the blends are selected from cellulose acetate, cellulose acetate butyrate, cellulose acetate propionate, triacetate cellulose, polylactic acid, starch, polyvinyl alcohol, chitosan, and PHBV.

The blends are subjected to the tests described above and are found to be more biodegradable and compostable than are compositions containing only a natural cellulosic fiber or a thermoplastic biodegradable fiber.

Fibrous blends of natural cellulosic and thermoplastic biodegradable fibers which blends comprise more than one type of natural cellulosic fibers, such as cotton and ramie or sisal and hemp, and/or more than one type of thermoplastic biodegradable fibers, such as cellulose acetate and polyvinyl alcohol or cellulose acetate butyrate and polylactic acid, are also expected to exhibit biodegradability and compostability.

Additional information relevant to the present invention can be found in the references listed below, which references are expressly incorporated herein, in their entirety, by reference.

As will be apparent to those skilled in the art, in light of the foregoing disclosure, many modifications, alterations, and substitutions are possible in the practice of this invention without departing from the spirit or scope thereof.

REFERENCES

1. Abrams, E., Microbiological Deterioration of Cellulose During the First 72 Hours of Attack, *Textile Research Journal*, 20, 71–86 (1950).

2. Béguin, P., and Aubert, J., The Biological Degradation of Cellulose, *FEMS Microbiology Reviews*, 13, 25–58 (1994).
3. Buchanan, C. M., Gardner, R. M., and Komarek, R. T., Aerobic Biodegradation of Cellulose Acetate, *Journal of Applied Polymer Science*, 47, 1709–1719 (1993).
4. Celanese® Cellulose Acetate : Engineered for Performance, Celanese Corporation, 1984.
5. Cooke, T. F., Biodegradability of Polymers and Fibers—A Review of the Literature, *Journal of Polymer Engineering*, 9, 171–211 (1990).
6. Cooke, T. F., Resistance to Microbiological Deterioration of Resin-Treated Cellulosic Fabrics, *Textile Research Journal*, 24, 197–209 (1954).
7. Desai, A. J., and Pandey, S. N., Microbial Degradation of Cellulosic Textiles, *Journal of Scientific and Industrial Research*, 30, 598 (1971).
8. Duckett, K. E., and Wadsworth, L. C., Physical Characterization of Thermally Point-Bonded Cotton/Polyester Nonwovens, in "Proceedings of the 1988 TAPPI Nonwovens Conference," 1988, pp. 99–107.
9. Duckett, K. E., and Wadsworth, L. C., Tensile Properties of Cotton/ Polyester Staple Fiber Nonwovens, in "Proceedings of the 1987 TAPPI Nonwovens Conference," 1987, pp. 121–127.
10. Duckett, K. E., Wadsworth, L. C., and Sharma, V., Comparison of Layered and Homogeneously Blended Cotton and Thermally Bonding Bicomponent Fiber Webs, in "Proceedings of the 1994 TAPPI Nonwovens Conference," 1994, pp. 13–18.
11. Finch, P., and Roberts, J. C., Enzymatic Degradation of Cellulose, in "Cellulose Chemistry and Its Application," T. P. Nevell, and S. H. Zeronian, Eds., Ellis Horwood, West Sussex, England, 1985, pp. 312–343.
12. Gu, J., Gada, M., McCarthy, S., and Gross, R., Degradability of Cellulose Acetate and Cellophane in Anaerobic Bioreactors, *Polymeric Materials Science and Engineering*, 67, 230–231 (1992).
13. Gu, J., Gada, M., McCarthy, S., Gross, R., and Eberiel, D., Degradability of Cellulose Acetate and Poly(lactide) in Stimulated Composting Bioreactors, *Polymeric Materials Science and Engineering*, 67, 351–352 (1992).
14. Levinson, H. S., and Reese, E. T., Enzymatic Hydrolysis of Soluble Cellulose Derivatives as Measured by Changes in Viscosity, *Journal of General Physiology*, 33, 601–628 (1950).
15. McCarthy, S. P., Overviews of State of Biodegradable Polymers, in "2nd. TANDEC Conference," TN, 1992.
16. Nelson, M., McCarthy, S., and Gross, R., Isolation of Pseudomonas Paucimobilis Capable of Using Insoluble Cellulose Acetate as a Sole Carbon Source, *Polymeric Materials Science and Engineering*, 67, 139–140 (1992).
17. Reed, R. E., U.S. Pat. No. 2 277 049, 1942.
18. Reed, R. E., and Ryan, J. F., U.S. Pat. No. 2,277,050, 1942.
19. Reese, E. T., Biological Degradation of Cellulose Derivatives, *Industrial and Engineering Chemistry*, 49, 89–92 (1957).
20. Schaffer, R. E., and Sharrod, D., The Solvent Bonding of Synthetic Fibers, in "New Ways to Produce Textiles : A Report on the 1972 Annual Conference of the Textile Institute ; Parts I and II," 1972, pp. 24–39.
21. Singleton, P., and Sainsbury, D., "Dictionary of Microbiology and Molecular Biology," 2 nd., John Wiley & Sons Ltd., Great Britain, 1987, pp. 161–162.
22. Siu, R. G. H., Microbial Decomposition of Cellulose, Reinhold Publishing Corp., New York, 1951.
23. Siu, R. G. H., Darby, R. T., Burkholder, P. R., and Barghoorn, E. S., Specificity of Microbiological Attack on Cellulose Derivatives, *Textile Research Journal*, 19, 484–488 (1949).
24. Weigmann, H., Interactions between Fibers and Organic Solvents, in "Handbook of Fiber Science and Technology: Vol. I Chemical Processing of Fibers and Fabrics," M. Lewin and S. B. Sello, Eds., Marcel Dekker, Inc., New York, 1983, pp. 1–49.

What is claimed is:

1. A compostable nonwoven fabric comprising a blend of natural cellulosic fibers and biodegradable thermoplastic fibers wherein the ratio of the natural cellulosic fibers to the biodegradable thermoplastic fibers is such that the rate of biodegradability of the blend is greater than the rate of biodegradability of either of the natural cellulosic fibers or the biodegradable thermoplastic fibers alone, and wherein the natural cellulosic fiber is selected from the group consisting of cotton, jute, flax, ramie, hemp, kenaf, abaca, sisal, kapok, bagasse, and eucalyptus.

2. The fabric of claim 1 wherein the natural cellulosic fiber is cotton.

3. The fabric of claim 1 wherein the thermoplastic biodegradable fiber is selected from the group consisting of cellulose acetate, cellulose acetate butyrate cellulose acetate propionate, triacetate cellulose, polylactic acid, polyvinyl alcohol, and chitosan.

4. The fabric of claim 3 wherein the thermoplastic biodegradable fiber is celloluse acetate.

5. The fabric of claim 1 wherein the natural cellulosic fiber is cotton and the thermoplastic biodegradable fiber is cellulose acetate.

6. The fabric of claim 1 which is a carded fabric.

7. The fabric of claim 6 which is a multilayered carded fabric.

8. The fabric of claim 1 in which the two types of fibers of the blend are bonded to each other by the thermoplastic biodegradable fibers.

9. The fabric of claim 1 wherein the natural cellulosic fibers and thermoplastic biodegradable fibers in the blend are present in a ratio of 50/50 to 95/5.

10. The fabric of claim 9 wherein the ratio is about 75/25.

11. The fabric of claim 5 wherein the cotton fibers and cellulose acetate fibers in the blend are present in a ratio of 50/50 to 5/95.

12. The fabric of claim 11 wherein the ratio is about 25/75.

13. The fabric of claim 6 which is a calendered fabric.

14. The fabric of claim 13 in which the fibers are thermally bonded to each other.

15. The fabric of claim 5 which degrades in response to the test for biodegradability of ASTM D5209-91.

16. The fabric of claim 5 which is compostable according to standard AATCC 30-1988 burial test.

17. A compostable nonwoven fabric comprising a blend of natural cellulosic fibers and biodegradable thermoplastic fibers wherein the ratio of the natural cellulosic fibers to the biodegradable thermoplastic fibers is such that the rate of biodegradability of the blend is greater than the rate of biodegradability of either of the natural cellulosic fibers or the biodegradable thermoplastic fibers alone, and wherein the natural cellulosic fibers and biodegradable fibers are thermally bonded to each other.

18. The compostable nonwoven fabric of claim 17 which is a calendered fabric.

19. The compostable nonwoven fabric of claim 17 wherein the natural cellulosic fiber is selected from the group consisting of cotton, jute, flax, ramie, hemp, kenaf, abaca, sisal, kapok, bagasse, eucalyptus, and rayon.

20. The compostable nonwoven fabric of claim 19 wherein the natural cellulosic fiber is cotton.

21. The compostable nonwoven fabric of claim 17 wherein the thermoplastic biodegradable fiber is selected from the group consisting of cellulose acetate, cellulose acetate butyrate, cellulose acetate propionate, triacetate cellulose, polylactic acid, polyvinyl alcohol, and chitosan.

22. The compostable nonwoven fabric of claim 21 wherein the thermoplastic biodegradable fiber is cellulose acetate.

23. The compostable nonwoven fabric of claim 22 wherein the natural cellulosic fiber is cotton.

24. The compostable nonwoven fabric of claim 17 which is a carded fabric.

25. A compostable nonwoven fabric comprising a blend of natural cellulosic fibers and biodegradable thermoplastic fibers in a ratio of the natural cellulosic fibers to the biodegradable thermoplastic fibers such that the rate of biodegradability of the blend is greater than the rate of biodegradability of either of the natural cellulosic fibers or the biodegradable thermoplastic fibers alone, wherein the fabric is a carded fabric.

26. The compostable nonwoven fabric of claim 25 which is a calendered fabric.

27. The compostable nonwoven fabric of claim 25 wherein the natural cellulosic fiber is selected from the group consisting of cotton, jute, flax, ramie, hemp, kenaf, abaca, sisal, kapok, bagasse, eucalyptus, and rayon.

28. The compostable nonwoven fabric of claim 27 wherein the natural cellulosic fiber is cotton.

29. The compostable nonwoven fabric of claim 25 wherein the thermoplastic biodegradable fiber is selected from the group consisting of cellulose acetate, cellulose acetate butyrate, cellulose acetate propionate, triacetate cellulose, polylactic acid, polyvinyl alcohol, and chitosan.

30. The compostable nonwoven fabric of claim 29 wherein the thermoplastic biodegradable fiber is cellulose acetate.

31. The compostable nonwoven fabric of claim 30 wherein the natural cellulosic fiber is cotton.

32. A process for the manufacture of a compostable non-woven fabric comprising a blend of natural cellulosic fibers and thermoplastic biodegradable fibers, which process comprises thoroughly mixing the natural cellulosic fibers with the thermoplastic biodegradable fibers to obtain a fibrous blend, wherein the ratio of the natural cellulosic fibers to the biodegradable thermoplastic fibers is such that the rate of biodegradability of the blend is greater than the rate of biodegradability of either of the natural cellulosic fibers or the biodegradable thermoplastic fibers alone, and carding the blend to obtain the non-woven fabric.

33. The process of claim 32 wherein the natural cellulosic fibers are selected from the group consisting of cotton, jute, flax, ramie, hemp, kenaf, abaca, sisal, kapok, bagasse, eucalyptus, and rayon, and the thermoplastic biodegradable fibers are selected from the group consisting of cellulose acetate, cellulose acetate butyrate, cellulose acetate propionate, triacetate cellulose, polylactic acid, polyvinyl alcohol, and chitosan.

34. The process of claim 32 which further comprises thermally bonding the carded non-woven fabric.

35. The process of claim 34 which further comprises before thermal bonding, exposing the non-woven fabric to vapors of a solvent for the thermoplastic biodegradable fiber.

36. The process of claim 35 wherein the solvent is acetone.

37. The process of claim 32 wherein the fabric is a blend of cotton/cellulose acetate fibers in a ratio of between about 50/50 and 75/25 which has a basis weight of about 160 $gm/m^2$, and wherein the process further comprises calendering the carded composition at a temperature of 170°–240° C. and at a feed roll speed of about 10 m/min.

38. The process of claim 37 which further comprises, before calendering, exposing the carded composition to acetone vapors for about 30 to 120 minutes.

* * * * *